US009874230B2

(12) United States Patent
Lardy et al.

(10) Patent No.: US 9,874,230 B2
(45) Date of Patent: Jan. 23, 2018

(54) GAS TAKEOFF ISOLATION SYSTEM

(71) Applicants: Pascal Lardy, Houston, TX (US); Jose L. Gilarranz, Katy, TX (US); William C. Maier, Almond, NY (US)

(72) Inventors: Pascal Lardy, Houston, TX (US); Jose L. Gilarranz, Katy, TX (US); William C. Maier, Almond, NY (US)

(73) Assignee: Dresser-Rand Company, Olean, NY (US)

( * ) Notice: Subject to any disclaimer, the term of this patent is extended or adjusted under 35 U.S.C. 154(b) by 361 days.

(21) Appl. No.: 14/639,221

(22) Filed: Mar. 5, 2015

(65) Prior Publication Data

US 2015/0308459 A1 Oct. 29, 2015

Related U.S. Application Data

(60) Provisional application No. 61/979,730, filed on Apr. 15, 2014.

(51) Int. Cl.

| | |
|---|---|
| ***F04D 13/08*** | (2006.01) |
| ***F04D 13/10*** | (2006.01) |
| ***B01D 45/12*** | (2006.01) |
| ***B01D 17/02*** | (2006.01) |
| ***B01D 19/00*** | (2006.01) |
| ***B01D 21/26*** | (2006.01) |

(Continued)

(52) U.S. Cl.

CPC ..... *F04D 29/701* (2013.01); *F04D 17/122* (2013.01); *F04D 29/5806* (2013.01); *F04D 25/0686* (2013.01); *F04D 29/5826* (2013.01)

(58) Field of Classification Search

CPC ..... F01D 13/08; F01D 13/10; B01D 45/12; B01D 17/0217; B01D 19/0057; B01D 21/267; H02P 6/15; E21B 43/128

See application file for complete search history.

(56) References Cited

U.S. PATENT DOCUMENTS

| | | | |
|---|---|---|---|
| 3,885,934 | A | 5/1975 | Eads et al. |
| 4,311,494 | A | 1/1982 | Conner et al. |

(Continued)

FOREIGN PATENT DOCUMENTS

| | | | |
|---|---|---|---|
| DE | 102012204403 | A1 | 9/2013 |
| JP | H05187205 | A | 7/1993 |
| WO | 2005095772 | A1 | 10/2005 |

OTHER PUBLICATIONS

PCT International Search Report and Written Opinion dated Jun. 16, 2015 corresponding to PCT Application PCT/US2015/020666 filed Mar 16, 2015.

*Primary Examiner* — David A Reifsnyder

(57) ABSTRACT

A fluid takeoff assembly for a motor-compressor is provided and includes an outer pipe having an inlet and an outlet, and an inner pipe defining a fluid passage extending from an open axial end toward a closed axial end thereof and a radial opening fluidly coupled with the fluid passage. The inner pipe may be disposed in the outer pipe such that the open axial end and the closed axial end are oriented toward the outlet and the inlet, respectively, and the inner and outer pipes define an annular space therebetween. A cross-flow member may be coupled with the inner pipe and may define a flowpath fluidly coupled with the fluid passage via the radial opening. A vane and the cross-flow member may be disposed in the annular space and configured to at least partially induce a swirling flow in a process fluid flowing through the annular space.

20 Claims, 4 Drawing Sheets

(51) Int. Cl.

| | |
|---|---|
| ***E21B 43/12*** | (2006.01) |
| ***F04D 29/70*** | (2006.01) |
| ***F04D 17/12*** | (2006.01) |
| ***F04D 29/58*** | (2006.01) |
| *F04D 25/06* | (2006.01) |

(56) References Cited

U.S. PATENT DOCUMENTS

| | | | |
|---|---|---|---|
| 5,131,807 | A | 7/1992 | Fischer et al. |
| 7,867,309 | B2 | 1/2011 | Suzuta et al. |
| 8,408,879 | B2 | 4/2013 | Kidd et al. |

GAS TAKEOFF ISOLATION SYSTEM

This application claims the benefit of U.S. Provisional Patent Application having Ser. No. 61/979,730, which was filed Apr. 15, 2014. The aforementioned patent application is hereby incorporated by reference in its entirety into the present application to the extent consistent with the present application.

BACKGROUND

Conventional compact motor-compressors including a compressor directly coupled with a high-speed electric motor have been developed and are often utilized in a myriad of industrial processes (e.g., petroleum refineries, offshore oil production platforms, and subsea process control systems) to compress a process fluid. The compact motor-compressors may combine the high-speed electric motor with the compressor, such as a centrifugal compressor, in a single, hermetically-sealed housing. Through shared or coupled rotary shafts supported by a bearing system, the high-speed electric motor may drive or rotate the compressor to thereby compress the process fluid.

As the high-speed electric motor drives the compressor, heat may be generated by electrical systems configured to deliver electrical energy to a stator of the high-speed electric motor. Additional heat may also be generated through windage friction resulting from the rotating components operating in the compressed process fluid. Improper management of the heat may reduce operational efficiencies and may ultimately result in damage to the compact motor-compressors and/or components thereof (e.g., insulation of the stator). Additionally, increased temperatures resulting from the improper management of the heat may cause the bearing system to fail, which may cause the rotary shafts supported by the bearing system to fall onto adjacent mechanical surfaces.

In view of the foregoing, conventional compact motor-compressors may often utilize cooling systems (e.g., a semi-closed loop cooling system or a closed loop cooling system) to circulate a cooling fluid through the compact motor-compressors to manage the heat. The cooling fluid utilized in the cooling systems may often be the compressed process fluid from the compressor and may often contain contaminants (e.g., solids and/or liquids) that may compromise the integrity of the electrical systems and/or reduce the efficacy of the cooling systems by blocking flow passages or lines thereof. While the cooling systems may often incorporate filters (e.g., coalescing filters) to remove the contaminants from the compressed process fluid, the substantial costs of routinely maintaining and servicing the coalescing filters may be cost-prohibitive. Further, the cost associated with maintaining and servicing the coalescing filters may often be exacerbated when the compact motor-compressors are remotely located (e.g., subsea).

What is needed, then, is an improved system and method for reducing contaminants in a process fluid introduced into a cooling system of a compact motor-compressor.

SUMMARY

Embodiments of the disclosure may provide a fluid takeoff assembly for a motor-compressor. The fluid takeoff assembly may include an outer pipe having an inlet and an outlet. The fluid takeoff assembly may also include an inner pipe defining a fluid passage extending from an open axial end toward a closed axial end thereof and a radial opening fluidly coupled with the fluid passage. The inner pipe may be at least partially disposed in the outer pipe such that the open axial end is oriented toward the outlet of the outer pipe, the closed axial end is oriented toward the inlet of the outer pipe, and the inner pipe and the outer pipe at least partially define an annular space therebetween. The fluid takeoff assembly may also include a cross-flow member coupled with the inner pipe and defining a flowpath fluidly coupled with the fluid passage via the radial opening. The cross-flow member may be at least partially disposed in the annular space and configured to at least partially induce a swirling flow in a process fluid flowing through the annular space. A vane may be disposed in the annular space and coupled with the inner pipe. The vane may be configured to at least partially induce the swirling flow in the process fluid flowing through the annular space.

Embodiments of the disclosure may also provide another fluid takeoff assembly for a motor-compressor. The fluid takeoff assembly may include an outer pipe having a first axial end portion defining an inlet thereof and a second axial end portion defining an outlet thereof. The fluid takeoff assembly may also include an inner pipe having an open axial end and a closed axial end. The inner pipe may define a fluid passage extending from the open axial end toward the closed axial end and a radial opening fluid coupled with the fluid passage. The inner pipe may be at least partially disposed in the outer pipe such that the open axial end and the closed axial end thereof are disposed proximal the outlet and the inlet of the outer pipe, respectively, and the inner pipe and the outer pipe at least partially define an annular space therebetween. A cross-flow member may be coupled with the inner pipe and may define a flowpath fluidly coupled with the fluid passage via the radial opening. The cross-flow member may be at least partially disposed in the annular space and configured to at least partially induce a swirling flow in a process fluid flowing through the annular space. The fluid takeoff assembly may further include a plurality of vanes disposed in the annular space. The plurality of vanes may be coupled with the inner pipe and configured to at least partially induce the swirling flow in the process fluid flowing through the annular space.

Embodiments of the disclosure may further provide a method for removing contaminants from a process fluid introduced into a cooling system of a motor-compressor with a fluid takeoff assembly. The method may include introducing the process fluid into an outer pipe of the fluid takeoff assembly via an inlet thereof. The method may also include flowing the process fluid through an annular space of the fluid takeoff assembly. An inner radial surface of the outer pipe and an outer radial surface of an inner pipe of the fluid takeoff assembly may at least partially define the annular space therebetween. The method may also include at least partially inducing a swirling flow in the process fluid flowing through the annular space with a plurality of vanes and a cross-flow member to direct at least a portion of the contaminants contained in the process fluid toward the inner radial surface of the outer pipe and thereby provide a flow of a relatively clean process fluid along the outer radial surface of the inner pipe. The method may also include flowing a portion of the relatively clean process fluid to a fluid passage of the inner pipe via an open axial end thereof. The open axial end of the inner pipe may be disposed proximal an outlet of the outer pipe. The method may further include flowing the portion of the relatively clean process fluid from the fluid passage to a flowpath of the cross-flow member via a radial opening of the inner pipe. The method may also include flowing the portion of the relatively clean process fluid from the flowpath of the cross-flow member to the cooling system of the motor-compressor.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
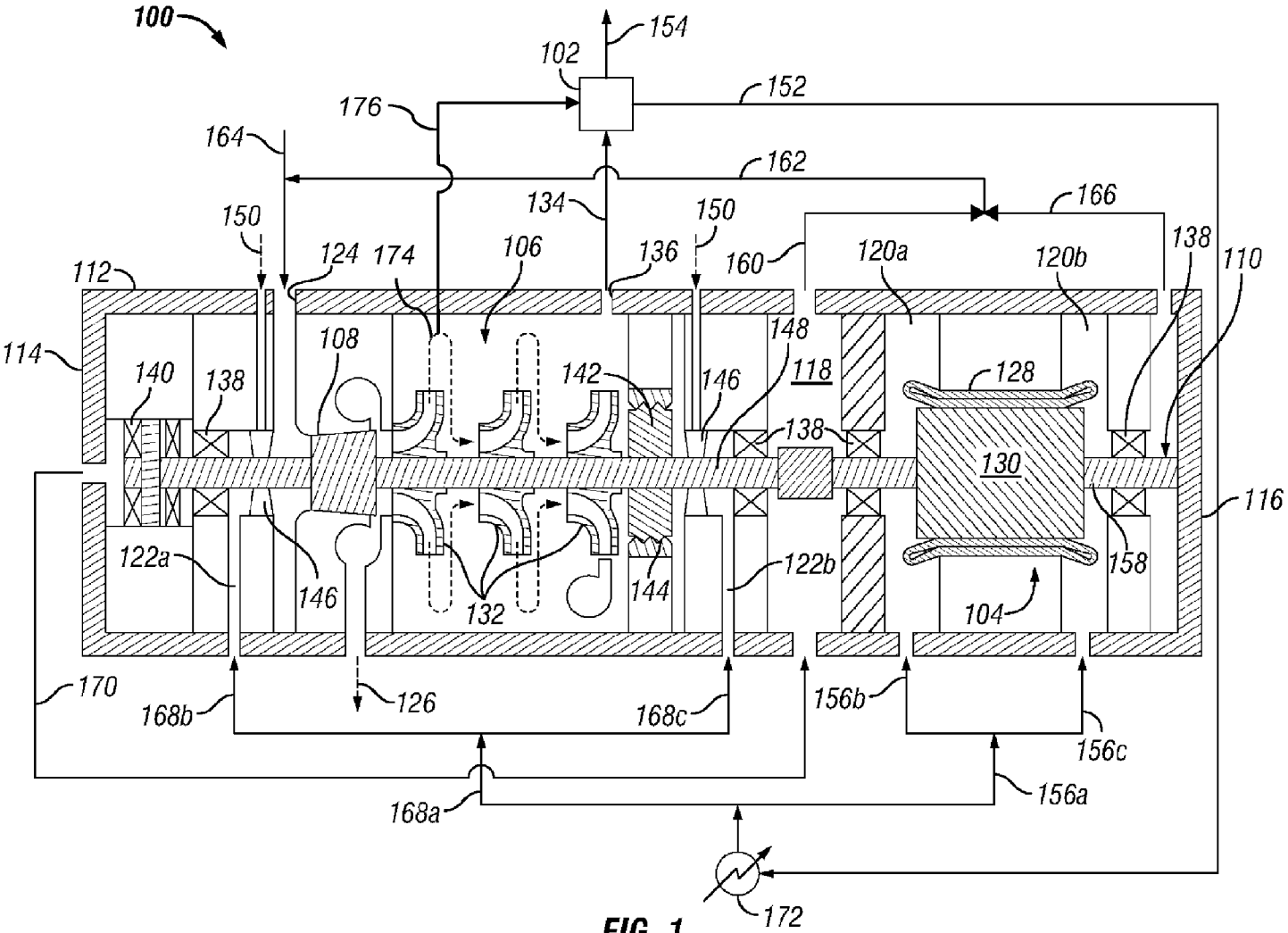
FIG. 1 illustrates a cross-sectional, schematic view of an exemplary motor-compressor including an exemplary fluid takeoff assembly fluidly coupled therewith, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a cross-sectional, schematic view of an exemplary motor-compressor 100 including an exemplary fluid takeoff assembly 102 fluidly coupled therewith, according to one or more embodiments. In at least one embodiment, the motor-compressor 100 may be utilized in a subsea application for the recovery and/or compression of a process fluid (e.g., hydrocarbons). It may be appreciated, however, that the motor-compressor 100 may be equally utilized in land-based applications without departing from the scope of the disclosure.

In at least one embodiment, the motor-compressor 100 may include a motor 104, a compressor 106, and a separator 108 coupled with one another via a rotary shaft 110. In another embodiment, the separator 108 may be omitted from the motor-compressor 100. The motor 104, the compressor 106, and/or the separator 108 may each be disposed in a housing 112 having a first end, or compressor end 114, and a second end, or motor end 116. The housing 112 may be configured to hermetically-seal the motor 104, the compressor 106, and/or the separator 108. In at least one embodiment, the housing 112 may define a cavity 118 and/or one or more internal cooling passages 120*a*, 120*b*, 122*a*, 122*b*. As further described herein, the cavity 118 and/or the internal cooling passages 120*a*, 120*b*, 122*a*, 122*b* may be configured to receive a cooling fluid (e.g., a "clean" process fluid) to regulate the temperature of the motor-compressor 100 and/or one or more components thereof.

In at least one embodiment, the separator 108 may be configured to at least partially separate and/or remove one or more high-density components (e.g., liquids and/or solids) from one or more low-density components (e.g., liquids and/or gases) contained within a process fluid introduced thereto. For example, the process fluid may be introduced to the separator 108 via an inlet 124 of the motor-compressor 100, and the separator 108 may at least partially remove the high-density components contained therein. The high-density components removed from the process fluid may be discharged from the separator 108 via line 126 to thereby provide a relatively drier or cleaner process fluid that may be introduced to the compressor 106. In at least one embodiment, the process fluid may be a multiphase fluid containing one or more liquids, gases, and/or solids, and the high-density components may include one or more liquids and/or one or more solids. Accordingly, the separator 108 may separate at least a portion of the liquids and/or the solids from the multiphase fluid and discharge the liquids and/or the solids via line 126. The discharged high-density components from line 126 may accumulate or be collected in a collection vessel (not shown) and may be subsequently combined with the process fluid at a pipeline location downstream of the compressor 106.

In at least one embodiment, the process fluid introduced into the motor-compressor 100 via the inlet 126 may be or include, but is not limited to, one or more hydrocarbons, which may be derived from a production field or a pressurized pipeline. For example, the process fluid may include methane, ethane, propane, butanes, pentanes, or the like, or any combination thereof. In at least one embodiment, the process fluid introduced into the motor-compressor 100 may also be or include one or more non-hydrocarbons. Illustrative non-hydrocarbons may include, but are not limited to, one or more particulates (e.g., solids), water, air, inert gases, or the like, or any combination thereof. Illustrative inert gases may include, but are not limited to, helium, nitrogen, carbon dioxide, or the like. In an exemplary embodiment, the process fluid may be or include a mixture of one or more hydrocarbons and one or more non-hydrocarbons.

In at least one embodiment, the motor 104 may be an electric motor, such as a permanent magnet motor, and may include a stator 128 and a rotor 130. It may be appreciated, however, that additional embodiments may employ other types of motors including, but not limited to, synchronous motors, induction motors, brushed DC motors, or the like. In at least one embodiment, the motor 104 may include a variable frequency drive (not shown) configured to drive the motor 104 and the compressor 106 coupled therewith at varying rates or speeds.

In at least one embodiment, the compressor 106 may be a multistage centrifugal compressor having one or more compressor stage impellers (three are shown 132). It may be appreciated, however, that any number of impellers 132 may be utilized without departing from the scope of the disclosure. The compressor 106 may be configured to receive the process fluid from the separator 108 or the inlet 124, and direct the process fluid through the impellers 132 to thereby provide a compressed or pressurized process fluid. As illustrated in FIG. 1, the pressurized process fluid may be discharged from the motor-compressor 100 via a discharge line 134 fluidly coupled with an outlet 136 defined in the housing 112.

In at least one embodiment, the motor-compressor 100 may include one or more radial bearings (four are shown 138) directly or indirectly supported by the housing 112 and configured to support the rotary shaft 110. Illustrative radial bearings 138 may include, but are not limited to, magnetic bearings, such as active or passive magnetic bearings, or the like. In at least one embodiment, one or more axial thrust bearings 140 may be coupled with the rotary shaft 110 to at least partially support and/or counteract thrust loads or forces generated by the compressor 106. As illustrated in FIG. 1, a balance piston 142 having a balance piston seal 144 may be coupled with and/or disposed about the rotary shaft 110 between the motor 104 and the compressor 106 and configured to at least partially counteract thrust loads applied thereto from the compressor 106.

In at least one embodiment, the motor-compressor 100 may include one or more buffer seals (two are shown 146) configured to prevent a "dirty" or multiphase process fluid from the compressor 106 from being directed or "leaked" to the radial bearings 138, the axial bearings 140, and/or the motor 104. As illustrated in FIG. 1, the buffer seals 146 may be disposed inboard of the radial bearings 138 near or proximal the end portions of a driven section 148 of the rotary shaft 110. Illustrative buffer seals 146 may be or include, but are not limited to, carbon ring seals, dry gas seals, brush seals, labyrinth seals, or the like, or any combination thereof.

In at least one embodiment, the buffer seals 146 may be configured to receive a flow of a pressurized seal gas via lines 150 to prevent the multiphase process fluid from the compressor 106 from being leaked to the radial bearings 138, the axial bearings 140, and/or the motor 104. The pressurized seal gas directed to the buffer seals 146 via lines 150 may be the pressurized process fluid from the compressor 106. For example, the pressurized process fluid discharged from the compressor 106 via discharge line 134 may be subsequently processed (e.g., via the fluid takeoff assembly 102) and directed to the buffer seals 146 via lines 150. The pressurized seal gas directed to the buffer seals 146 may include, but is not limited to, dry or clean hydrocarbons, hydrogen, inert gases, or the like, or any combination thereof. The pressurized seal gas directed to the buffer seals 146 may provide a pressure differential to prevent the process fluid (e.g., wet process fluid) from leaking across the buffer seals 146 to portions of the housing 112 where the radial bearings 138, the axial bearing 140, and/or the motor 104 may be disposed.

In an exemplary operation of the motor-compressor 100, the motor 104 may rotate the rotary shaft 110 to drive the compressor 106 and/or the separator 108 coupled therewith. The process fluid may be introduced into the motor-compressor 100 via inlet line 164 fluidly coupled with the inlet 124. The process fluid introduced into the motor-compressor 100 may be directed to the optional separator 108 or the compressor 106. The separator 108 may receive the process fluid via the inlet 124 and separate at least a portion of the high-density components (e.g., liquids and/or solids) therefrom. The high-density components separated from the process fluid may be removed or discharged via line 126, and the remaining process fluid may be directed to the compressor 106. The compressor 106 may receive the process fluid from the separator 108 or the inlet 124 and compress the process fluid through the impellers 132 thereof to provide the compressed or pressurized process fluid. The pressurized process fluid may then be discharged via discharge line 134 fluidly coupled with the outlet 136.

In at least one embodiment, illustrated in FIG. 1, the fluid takeoff assembly 102 may be fluidly coupled with the outlet 136 of the motor-compressor 100 via discharge line 134. As further described herein, the fluid takeoff assembly 102 may be configured to receive the pressurized process fluid from the motor-compressor 100 via discharge line 134 and separate and/or remove at least a portion of the high-density components and/or particulates (e.g., liquids and/or solids) from the pressurized process fluid to provide a "clean" process fluid. The terms or expressions "clean process fluid," "relatively clean process fluid," "clean process stream," or the like, refer to any process fluid or process stream that has been processed by the fluid takeoff assembly 102 to remove at least a portion of the high-density components and/or particulates (e.g., liquids and/or solids) contained therein. For example, the portion removed may be at least about 1%, at least about 2%, at least about 5%, at least about 10%, at least about 15%, at least about 20%, at least about 25%, at least about 30%, at least about 40%, at least about 50%, at least about 60%, or at least about 80% of the high-density components and/or particulates contained therein. As further described herein, at least a portion of the "clean" process fluid may be directed to one or more portions of the motor-compressor 100 via line 152 to regulate the temperature of the motor-compressor 100 and/or one or more components thereof. The remaining portions of the "clean" process fluid from the fluid takeoff assembly 102 may be directed to one or more downstream processes or assemblies (not shown) via line 154. In at least one embodiment, the remaining portions of the "clean" process fluid may be combined with the separated high-density components and/or particulates before being directed to the downstream processes or assemblies via line 154.

Figure 2B:
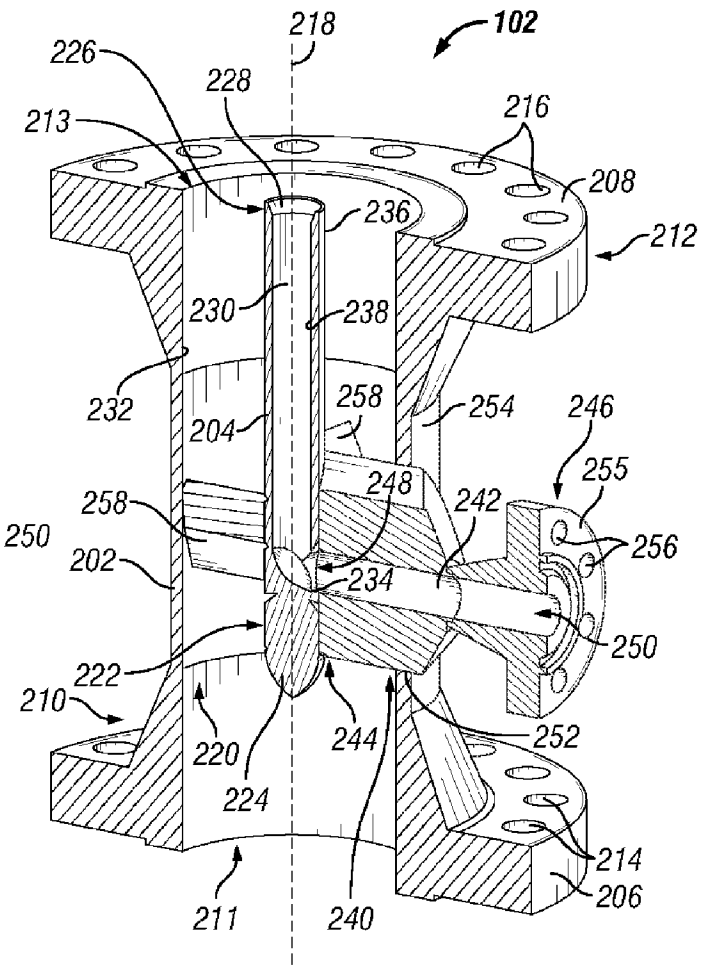
FIG. 2B illustrates a cross-sectional, perspective view of the fluid takeoff assembly of FIG. 2A, according to one or more embodiments disclosed.
Figure 2A:
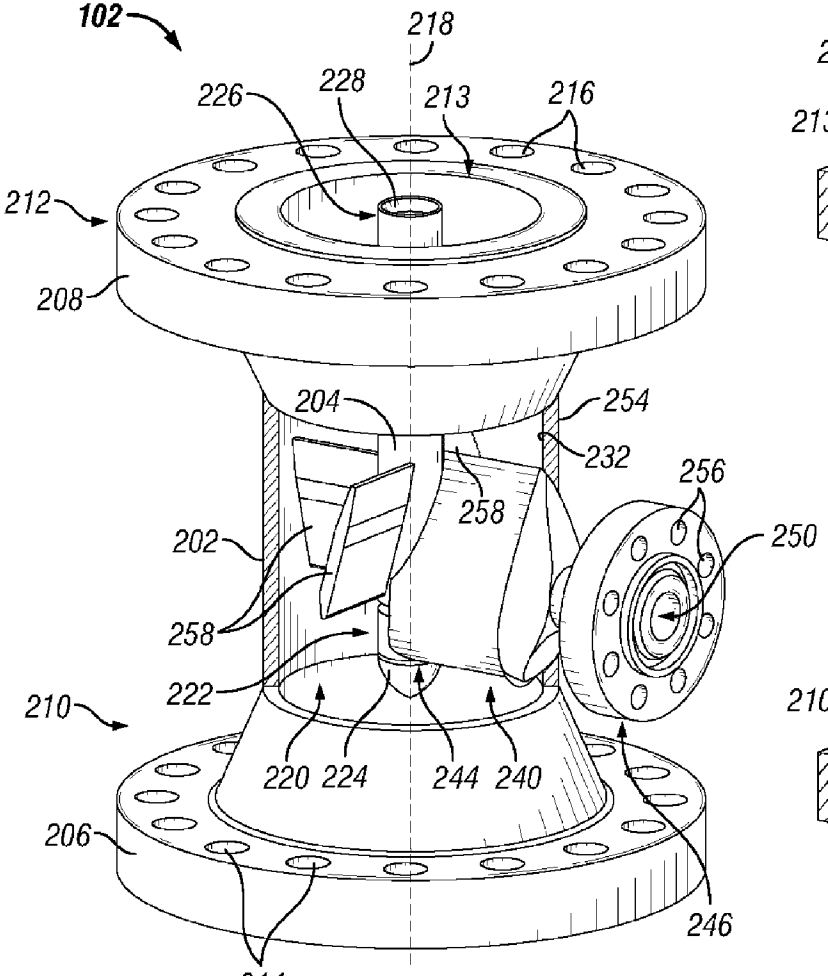
FIG. 2A illustrates a cut-away, perspective view of an exemplary fluid takeoff assembly, according to one or more embodiments disclosed.

FIGS. 2A and 2B illustrate a cut-away perspective view and a cross-sectional perspective view, respectively, of the fluid takeoff assembly 102, according to one or more embodiments. In at least one embodiment, the fluid takeoff assembly 102 may include an outer body 202 and an inner body 204 at least partially disposed within the outer body 202. The outer body 202 may be or include an annular member, such as a pipe, a pipe section, a duct, or any other type of conduit capable of receiving, containing, and/or flowing the process fluid therethrough. For example, as illustrated in FIGS. 2A and 2B, the outer body 202 may be an outer pipe. In at least one embodiment, illustrated in FIG. 2B, a first axial end portion 210 of the outer pipe 202 may define a first opening or inlet 211 of the outer pipe 202, and a second axial end portion 212 of the outer pipe 202 may define a second opening or outlet 213 of the outer pipe 202. As further described herein, the inlet 211 of the outer pipe 202 may be fluidly coupled with the outlet 136 (see FIG. 1) of the motor-compressor 100 via discharge line 134 and configured to receive the pressurized process fluid therefrom.

In at least one embodiment, the fluid takeoff assembly 102 may include one or more mounting flanges (two are shown 206, 208) coupled or integrally formed with the outer pipe 202. For example, as illustrated in FIGS. 2A and 2B, a first mounting flange 206 may be integrally formed with the first axial end portion 210 of the outer pipe 202, and a second mounting flange 208 may be integrally formed with the second axial end portion 212 of the outer pipe 202. The mounting flanges 206, 208 may be configured to detachably and fluidly couple the outer pipe 202 with one or more lines of the motor-compressor 100. For example, the first mounting flange 206 may detachably and fluidly couple the inlet 211 of the outer pipe 202 with discharge line 134 (see FIG. 1) of the motor-compressor 100. In another example, the second mounting flange 208 may detachably and fluidly couple the outlet 213 of the outer pipe 202 with line 154. As illustrated in FIGS. 2A and 2B, the first mounting flange 206 and the second mounting flange 208 may each may define a plurality of circumferentially-arrayed perforations or openings 214, 216 extending therethrough. The circumferentially-arrayed openings 214, 216 may be configured to receive one or more mechanical fasteners (not shown) to facilitate the coupling of the fluid takeoff assembly 102 with discharge line 134 and/or line 154 of the motor-compressor 100. Illustrative mechanical fasteners may include, but are not limited to, one or more bolts, studs and nuts, and/or any other known mechanical fasteners. In another embodiment, the fluid takeoff assembly 102 may be coupled with one or more lines of the motor-compressor 100 via other suitable means (e.g., direct welding). For example, the outer pipe 202 may be welded or integrally formed with discharge line 134 (see FIG. 1) and/or line 154.

In at least one embodiment, the inner body 204 may be or include an annular member, such as a pipe, a pipe section, a duct, or any other type of conduit capable of receiving, containing, and/or flowing the process fluid therethrough. For example, as illustrated in FIGS. 2A and 2B, the inner body 204 may be an inner pipe at least partially disposed in the outer pipe 202. As illustrated in FIGS. 2A and 2B, the inner pipe 204 may be concentric with the outer pipe 202 along a common axis 218 (e.g., longitudinal axis) of the fluid takeoff assembly 102. As further illustrated in FIGS. 2A and 2B, the inner pipe 204 and the outer pipe 202 may at least partially define an annular volume or space 220 therebetween. For example, an inner radial surface 232 of the outer pipe 202 and an outer radial surface 236 of the inner pipe 204 may at least partially define the annular space 220 therebetween.

In at least one embodiment, the inner pipe 204 may have a closed axial end 224 and an open axial end 228. For example, as illustrated in FIGS. 2A and 2B, a first axial end portion 222 of the inner pipe 204 may define the closed axial end 224, and a second axial end portion 226 of the inner pipe 204 may define the open axial end 228. As further illustrated in FIG. 2B, the inner pipe 204 may define a fluid passage 230 at least partially extending from the open axial end 228 toward the first axial end portion 222 and/or the closed axial end 224 thereof. In at least one embodiment, the inner pipe 204 may be oriented relative to the outer pipe 202 such that the closed axial end 224 thereof may be disposed proximal and/or directed toward the inlet 211 of the outer pipe 202, and the open axial end 228 thereof may be disposed proximal and/or directed toward the outlet 213 of the outer pipe 202.

In at least one embodiment, the first axial end portion 222 and/or the closed axial end 224 of the inner pipe 204 may be configured to deflect at least a portion of the process fluid directed thereto toward the annular space 220 and/or the inner radial surface 232 of the outer pipe 202. For example, at least a portion of the closed axial end 224 may be curved or arcuate such that the process fluid directed thereto may be deflected toward the annular space 220 and/or the inner radial surface 232 of the outer pipe 202. In another example, illustrated in FIGS. 2A and 2B, a contour of the closed axial end 224 may be convexly shaped to thereby direct the process fluid toward the annular space 220 and/or the inner radial surface 232 of the outer pipe 202. In at least one embodiment, the deflection of the process fluid toward the annular space 220 and/or the inner radial surface 232 may result in a minimal or insignificant loss in the total pressure of the process fluid.

In at least one embodiment, the inner pipe 204 may define an opening 234 extending radially therethrough and fluidly coupled with the fluid passage 230. For example, as illustrated in FIG. 2B, the opening 234 may extend from the outer radial surface 236 to and through an inner radial surface 238 of the inner pipe 204. As further illustrated in FIG. 2B, the opening 234 may be disposed near or proximal the first axial end portion 222 and/or the closed axial end 224 of the inner pipe 204.

In at least one embodiment, illustrated in FIG. 2B, the fluid takeoff assembly 102 may include a cross-flow member 240 coupled with the inner pipe 204. The cross-flow member 240 may define a flowpath or fluid passage 242 extending therethrough from a first axial end portion 244 to a second axial end portion 246 thereof. For example, as illustrated in FIG. 2B, the cross-flow member 240 may define an inlet 248 at the first axial end portion 244, an outlet 250 at the second axial end portion 246, and the fluid passage 242 extending from the inlet 248 to the outlet 250. In at least one embodiment, the cross-flow member 240 may be coupled with the inner pipe 204 such that the fluid passage 242 thereof may be in fluid communication with the fluid passage 230 of the inner pipe 204 via the opening 234 and the inlet 248. As further described herein, the cross-flow member 240 may be configured to fluidly couple the fluid passage 230 of the inner pipe 204 with one or more lines of the motor-compressor 100 and direct at least a portion of the "clean" process fluid to one or more portions of the motor-compressor 100 via the lines thereof.

In at least one embodiment, the cross-flow member 240 may extend from the inner pipe 204 to and through the annular space 220 and/or the outer pipe 202 of the fluid takeoff assembly 102. For example, as illustrated in FIG. 2B, the outer pipe 202 may define an opening 252 extending radially therethrough from an outer radial surface 254 to and through the inner radial surface 232 thereof, and the cross-flow member 240 may at least partially extend through the opening 252. In at least one embodiment, the cross-flow member 240 may at least partially support and/or align the inner pipe 204 within the outer pipe 202. For example, as illustrated in FIGS. 2A and 2B, the cross-flow member 240 may be coupled with the inner pipe 204 and the outer pipe 202 to support the inner pipe 204 within the outer pipe 202 and/or maintain the concentricity or alignment of the inner pipe 204 with the outer pipe 202. As further described herein, at least a portion of the cross-flow member 240 may be airfoil shaped, streamline shaped, or otherwise configured to at least partially promote or induce a swirling or vortical flow in the process fluid flowing through the annular space 220.

In at least one embodiment, the fluid takeoff assembly 102 may include a mounting flange 255 coupled or integrally formed with the cross-flow member 240. For example, as illustrated in FIG. 2B, the mounting flange 255 may be coupled with the second axial end portion 246 and/or the outlet 250 of the cross-flow member 240. The mounting flange 255 may be configured to detachably and fluidly couple the cross-flow member 240 with one or more lines of the motor-compressor 100. For example, the mounting flange 255 may detachably and fluidly couple the cross-flow member 240 with line 152 (see FIG. 1) of the motor-compressor 100. As illustrated in FIGS. 2A and 2B, the mounting flange 255 may define one or more circumferentially-arrayed openings 256 extending therethrough and configured to receive one or more mechanical fasteners to facilitate the coupling of the cross-flow member 240 with line 152 of the motor-compressor 100. Illustrative mechanical fasteners may include, but are not limited to, one or more bolts, studs and nuts, and/or any other known mechanical fasteners. In another embodiment, the cross-flow member 240 may be coupled with one or more lines of the motor-compressor 100 via other suitable means (e.g., direct welding). For example, the cross-flow member 240 may be welded or integrally formed with line 152 (e.g., takeoff piping).

In at least one embodiment, one or more blades or vanes (three are shown 258 in FIG. 2A) may be disposed in the annular space 220 between the inner pipe 204 and the outer pipe 202. As further described herein, the vanes 258 may be configured to at least partially promote or induce a swirling or vortical flow in the process fluid flowing through the annular space 220. For example, the vanes 258 may be configured to work in concert with the cross-flow member 240 to at least partially induce the swirling flow in the process fluid flowing through the annular space 220. In at least one embodiment, the vanes 258 may at least partially support and/or align the inner pipe 204 within the outer pipe 202. For example, as illustrated in FIGS. 2A and 2B, the vanes 258 may be coupled with the inner pipe 204 and the outer pipe 202 to support the inner pipe 204 within the outer pipe 202 and/or maintain the concentricity or alignment of the inner pipe 204 with the outer pipe 202. In another embodiment, the vanes 258 may be coupled with the inner pipe 204 and may extend radially through at least a portion of the annular space 220 from the inner pipe 204 toward the inner radial surface 232 of the outer pipe 202.

In at least one embodiment, the vanes 258 and/or the cross-flow member 240 may be annularly spaced at substantially equal intervals or at varying intervals about the inner pipe 204 of the fluid takeoff assembly 102. For example, as illustrated in FIG. 2A, the vanes 258 and the cross-flow member 240 may be uniformly disposed about the inner pipe 204 in an annular array. As previously discussed, the vanes 258 and/or the cross-flow member 240 may be configured to induce a swirling flow in the process fluid flowing through the annular space 220. In at least one embodiment, the vanes 258 and/or the cross-flow member 240 may be shaped to induce the swirling flow in the process fluid. In another embodiment, the vanes 258 and/or the cross-flow member 240 may be tilted, pitched, cambered, helically oriented, or otherwise angled relative to the longitudinal axis 218 of the fluid takeoff assembly 102 to induce the swirling flow. For example, as illustrated in FIGS. 2A and 2B, the vanes 258 and/or the cross-flow member 240 may be pitched and/or helically oriented in a direction that induces a clockwise swirling flow in the process fluid flowing through the annular space 220 from the inlet 211 toward the outlet 213.

In an exemplary operation, the fluid takeoff assembly 102 may be fluidly coupled with the motor-compressor 100 and configured to receive the process fluid therefrom. For example, referring to FIGS. 2A and 2B with continued reference to FIG. 1, the inlet 211 may be fluidly coupled with the outlet 136 of the motor-compressor 100 via discharge line 134 and configured to receive the process fluid therefrom. The process fluid directed to the fluid takeoff assembly 102 may generally flow through the annular space 220 from the inlet 211 toward the outlet 213 of the outer pipe 202. In at least one embodiment, at least a portion of the process fluid directed to the fluid takeoff assembly 102 may flow toward the closed axial end 224 of the inner pipe 204 and be deflected by the closed axial end 224 toward the annular space 220. For example, as previously discussed, at least a portion of the closed axial end 224 may be curved or arcuate to thereby deflect the process fluid toward the annular space 220.

Figure 2C:
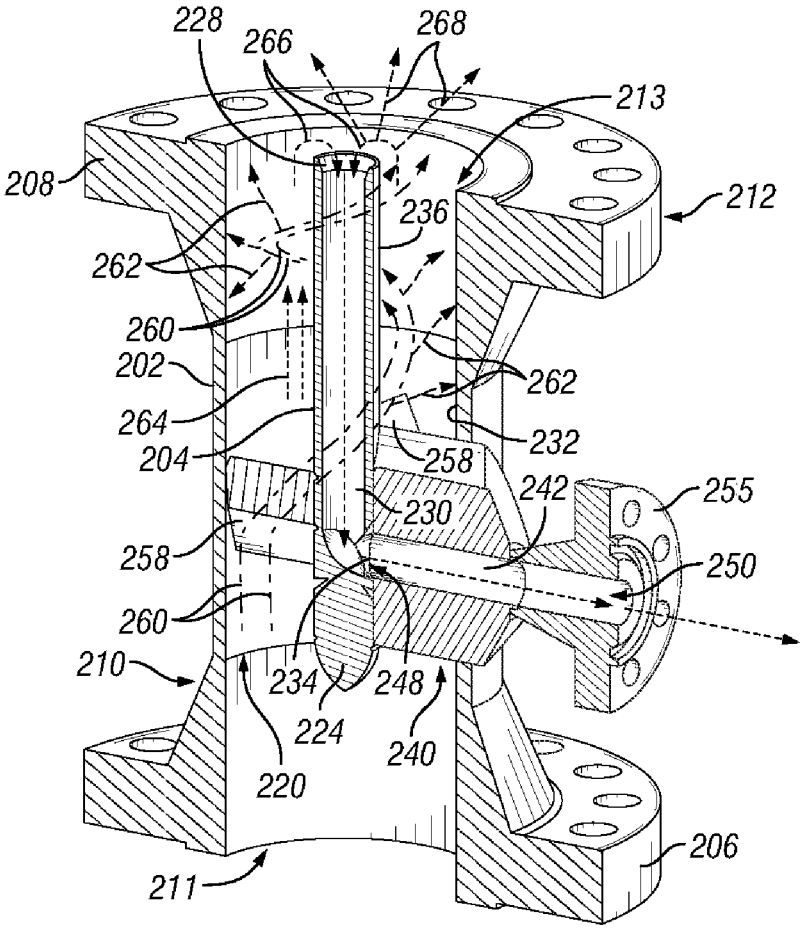
FIG. 2C illustrates a process fluid flowing through the fluid takeoff assembly of FIGS. 2A and 2B, according to one or more embodiments disclosed.

Referring to FIG. 2C, the vanes 258 and/or the cross-flow member 240 disposed in the annular space 220 may promote or induce a swirling flow in the process fluid flowing therethrough, as indicated by dashed arrows 260. For example, as previously discussed, the shape and/or orientation (e.g., helical orientation) of the vanes 258 and/or the cross-flow member 240 may induce the swirling flow 260 in the process fluid flowing through the annular space 220. In at least one embodiment, the swirling flow 260 may cause at least a portion of the relatively higher density components (e.g., solid and/or liquid particles) to separate from at least a portion of the relatively lower density components (e.g., gases) contained in the process fluid. For example, as illustrated in FIG. 2C, a force (e.g., centrifugal force) of the swirling flow 260 may cause at least a portion of the solid and/or liquid particles to migrate or flow radially outward toward the inner radial surface 232 of the outer pipe 202, as indicated by dashed arrows 262, to thereby separate the portion of the solid and/or the liquid particles from the gases contained in the process fluid. In at least one embodiment, the migration of the solid and/or liquid particles 262 toward the inner radial surface 232 of the outer pipe 202 may cause at least a portion of the relatively lower density components (e.g., gases) to migrate radially inward toward the outer radial surface 236 of the inner pipe 204. Accordingly, the swirling flow 260 and the subsequent migration of the solid and/or liquid particles 262 may cause the relatively lower density components (e.g., gases) to collect or otherwise coalesce near or about the outer radial surface 236 of the inner pipe 204. The coalescing of the relatively lower density components near or about the outer radial surface 236 of the inner pipe 204 may provide a flow of a relatively "clean" process fluid along or proximal the outer radial surface 236 of the inner pipe 204, as indicated by dashed arrows 264.

In at least one embodiment, at least a portion of the relatively "clean" process fluid 264 at or proximal the outer radial surface 236 of the inner pipe 204 may flow to the fluid passage 230 of the inner pipe 204 via the open axial end 228 thereof. As previously discussed, the inner pipe 204 may be oriented such that the open axial end 228 thereof may be disposed proximal or directed toward the outlet 213 of the outer pipe 202. Accordingly, the flow of the relatively "clean" process fluid 264 may turn or change directions before flowing to the fluid passage 230 via the open axial end 228. For example, as illustrated in FIG. 2C, the flow of the relatively "clean" process fluid 264 may turn about 180° before flowing to the fluid passage 230 via the open axial end 228, as indicated by dashed arrows 266. In another example, the flow of the relatively "clean" process fluid 264 may turn at least about 90°, at least about 120°, at least about 150°, or more, before flowing to the fluid passage 230 via the open axial end 228. In at least one embodiment, the turning flow of the relatively "clean" process fluid 266 may cause at least a portion of the remaining higher density components to separate from the relatively "clean" process fluid, as indicated by dotted arrows 268. Accordingly, the turning flow of the relatively "clean" process fluid 268 may further reduce the concentration or amount of the higher density components contained in the "clean" process fluid flowing through the fluid passage 230 of the inner pipe 204. The "clean" process fluid may flow through the fluid passage 230 of the inner pipe 204 from the open axial end 228 toward the closed axial end 224. The process fluid in the fluid passage 230 may then be directed to the fluid passage 242 of the cross-flow member 240 via the opening 234 and the inlet 248. The "clean" process fluid may then flow through the fluid passage 242 of the cross-flow member 240 and be directed to the motor-compressor 100 via the outlet 250 of the cross-flow member 240 and line 152 (see FIG. 1) fluidly coupled therewith. It may be appreciated that removing at least a portion of the high-density components from the process fluid in the fluid takeoff assembly 102 may allow the process fluid to be circulated through the motor-compressor 100 with less energy or power and thereby increase an efficiency of the motor-compressor 100.

Referring back to FIG. 1, the "clean" process fluid from the fluid takeoff assembly 102 may be directed to one or more portion of the motor-compressor 100 via line 152 to regulate the temperature of the motor 104, the radial bearings 138, and/or the axial bearings 140 of the motor-compressor 100. In at least one embodiment, the "clean" process fluid from the fluid takeoff assembly 102 may be directed to a cooling circuit of the motor-compressor 100. As further discussed herein, the cooling circuit may include the cavity 118, the internal cooling passages 120*a*, 120*b*, 122*a*, 122*b*, and/or one or more lines fluidly coupled with the cavity 118 and/or the internal cooling passages 120*a*, 120*b*, 122*a*, 122*b*. For example, as illustrated in FIG. 1, the "clean" process fluid may be directed to the internal cooling passages 120*a*, 120*b* via lines 156*a*, 156*b*, 156*c* to cool the motor 104 and/or the radial bearings 138 of the motor-compressor 100. In at least one embodiment, the "clean" process fluid directed to the internal cooling passages 120*a*, 120*b* may flow through one or more portions of the motor 104 to cool one or more components thereof. For example, the "clean" process fluid in the internal cooling passages 120*a*, 120*b* may flow to the stator 128 and/or rotor 130 to remove at least a portion of the heat generated by the motor 104. The "clean" process fluid directed to the internal cooling passages 120*a*, 120*b* may also flow through the radial bearings 138 supporting a motor section 158 of the rotary shaft 110 to thereby remove at least a portion of heat generated by the radial bearings 138. For example, the "clean" process fluid in the internal cooling passages 120*a*, 120*b* may flow through a gap (not shown) defined between each of the radial bearings 138 and the motor section 158 of the rotary shaft 110 to remove the heat generated by the radial bearings 138.

As illustrated in FIG. 1, the "clean" process fluid in the internal cooling passage 120*a* on a first side of the motor 104 (i.e., the left side as illustrated in FIG. 1) may flow from the internal cooling passage 120*a* to the cavity 118 via the radial bearings 138. The heated or thermally "spent" process fluid in the cavity 118 may be discharged from the cavity 118 via a return line 160 fluidly coupled therewith. In at least one embodiment, the return line 160 may fluidly couple the cavity 118 with the inlet 124 of the motor-compressor 100. For example, as illustrated in FIG. 1, the return line 160 may be fluidly coupled with the inlet 124 via line 162 and inlet line 164. In another embodiment, the return line 160 may fluidly couple the cavity 118 with a blower (not shown) of the motor-compressor 100. As further illustrated in FIG. 1, the "clean" process fluid in the internal cooling passage 120*b* on a second side of the motor 104 (i.e., the right side as illustrated in FIG. 1) may flow through the radial bearings 138 and combine with the spent process fluid in the return line 160 via line 166. It should be noted that the terms "left" and "right," or other directions and orientations described herein, are provided for clarity in reference to the Figures and are not intended to be limiting of the actual system or use thereof.

As further illustrated in FIG. 1, the "clean" process fluid from the fluid takeoff assembly 102 may also be directed to internal cooling passages 122*a*, 122*b* via lines 168*a*, 168*b*, 168*c* to cool the respective radially bearings 138 supporting the driven section 148 of the rotary shaft 110. As the "clean" process fluid nears the radial bearings 138 supporting the driven section 148, the buffer seals 146 may prevent the "clean" process fluid from flowing to portions of the housing 112 where the compressor 106 and/or the separator 108 may be disposed. Instead, the "clean" process fluid may flow through the radial bearings 138 supporting the driven section 148, and may be subsequently directed to the cavity 118. For example, the "clean" process fluid in the internal cooling passage 122*a* may flow through the radial bearing 138 disposed near or adjacent the compressor end 114 of the housing 112 and may subsequently be discharged from the housing 112 to the cavity 118 via line 170. The "clean" process fluid in the internal cooling passage 122*a* may also flow through the axial thrust bearings 140 prior to being discharged from the housing 112.

As illustrated in FIG. 1, the "clean" process fluid flowing through the internal cooling passage 122*b* may be directed to the cavity 118 via the radial bearings 138. Accordingly, the spent process fluid from the internal cooling passages 122*a*, 122*b* may combine with one another in the cavity 118, and may further combine with the spent process fluid from the internal cooling passage 120*a*. As previously discussed, the spent process fluid in the cavity 118 may be discharged from the housing 112 via the return line 160 and may subsequently be directed to the inlet 124 of the compressor 106 or a blower (not shown) of the motor-compressor 100.

In at least one embodiment, a heat exchanger 172 may be disposed downstream from and fluidly coupled with the fluid takeoff assembly 102, and configured to cool or reduce the temperature of the "clean" process fluid therefrom. For example, as illustrated in FIG. 1, the heat exchanger 172 may be disposed downstream from and fluidly coupled with the fluid takeoff assembly 102 via line 152. The heat exchanger 172 may be or include any device capable of reducing the temperature of the process fluid flowing therethrough. Illustrative heat exchangers 172 may include, but are not limited to, a direct contact heat exchanger, a trim cooler, a mechanical refrigeration unit, or the like, or any combination thereof. It may be appreciated that cooling the "clean" process fluid may allow the process fluid to be circulated through the motor-compressor 100 with less work or energy, thereby increasing the efficiency of the motor-compressor 100.

While FIG. 1 illustrates the fluid takeoff assembly 102 fluidly coupled with discharge line 134 of the motor-compressor 100, it may be appreciated that the fluid takeoff assembly 102 may also be fluidly coupled with other sections, lines, and/or fluid passages of the motor-compressor 100. In at least one embodiment, the fluid takeoff assembly 102 may be fluidly coupled with one or more fluid passages of the compressor 106, such as a volute and/or an interstage fluid passage 174. For example, as illustrated in FIG. 1, the fluid takeoff assembly 102 may be fluidly coupled with the interstage fluid passage 174 via line 176 and configured to receive the pressurized process fluid from the interstage fluid passage 174 of the compressor 106. In at least one embodiment, the pressurized process fluid from the interstage fluid passage 174 may be at an intermediate pressure. For example, the pressurized process fluid from the interstage fluid passage 174 may have a pressure relatively greater than the pressure of the process fluid from inlet line 164 and relatively less than the pressure of the process fluid from discharge line 134. The pressurized process fluid may be extracted from the interstage fluid passage 174 of the compressor 106, processed by the fluid takeoff assembly 102, and subsequently injected or introduced back into the motor-compressor 100. In at least one embodiment, the pressurized process fluid may be introduced back into a portion or section of the motor-compressor 100 having a pressure equal or substantially equal to the pressure at the interstage fluid passage 174. For example, the pressurized process fluid may be introduced back into a portion of the motor-compressor 100 maintained at the intermediate pressure.

It may further be appreciated that the fluid takeoff assembly 102 may be fluidly coupled with various types of cooling system. For example, the fluid takeoff assembly 102 may be fluidly coupled with a semi-closed loop cooling system, a closed-loop cooling system, or the like. The semi-closed loop cooling system and the closed-loop cooling system may be similar to those described in pending U.S. patent application Ser. No. 13/477,254, filed on May 22, 2012, and published as U.S. Pub. No. 2013/0136629, the contents of which are hereby incorporated by reference to the extent consistent with the present disclosure.

Referring back to FIGS. 2A-2C, it may further be appreciated that one or more design parameters of the vanes 258 and/or the cross-flow member 240, such as the number, size, pitch, distribution, disposition, shape, and/or any other characteristic or parameter associated with the vanes 258 and/or the cross-flow member 240, may vary from one embodiment to another and may depend upon or be determined by one or more characteristics and/or parameters of the process fluid and/or the motor-compressor 100. For example, the design parameters of the vanes 258 and/or the cross-flow member 240 may be determined by the composition of the process fluid and/or the concentration of the high-density components contained in the process fluid. The design parameters of the vanes 258 and/or the cross-flow member 240 may also depend upon the location of the fluid takeoff assembly 102 relative to the motor-compressor 102 and/or the cooling system. Further, while FIGS. 2A-2C illustrate the fluid takeoff assembly 102 in a vertical orientation with the inlet 211 oriented downward and the outlet 213 oriented upward such that the process fluid flows in an upward direction, it may be appreciated that the fluid takeoff assembly 102 may be equally operable in a horizontal orientation or an inverted orientation such that the process fluid flows horizontally or downwardly, respectively.

Figure 3:
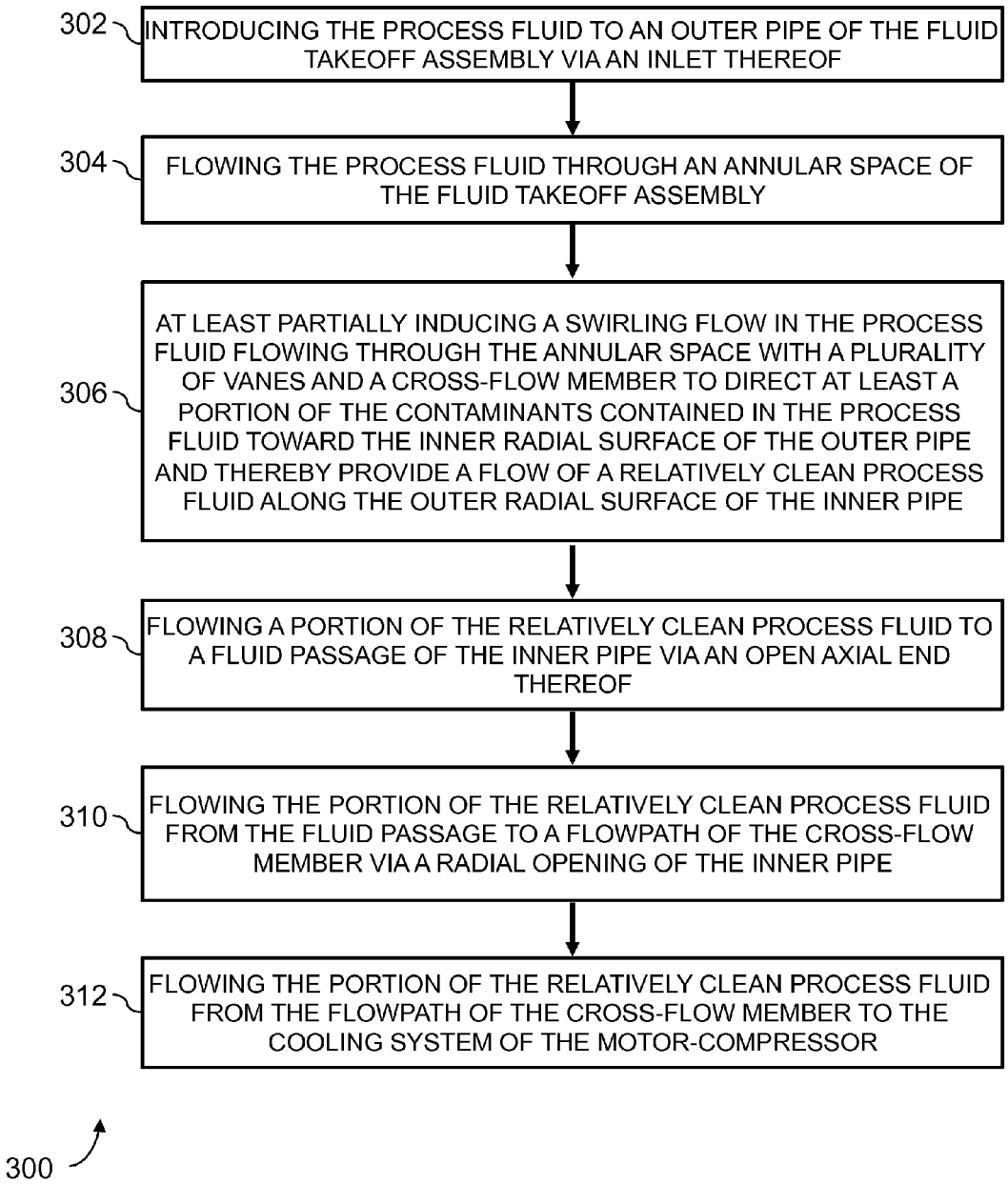
FIG. 3 illustrates a flowchart of a method for removing contaminant from a process fluid introduced into a cooling system of a motor-compressor with a fluid takeoff assembly, according to one or more embodiments disclosed.

FIG. 3 illustrates a flowchart of a method 300 for removing contaminant from a process fluid introduced into a cooling system of a motor-compressor with a fluid takeoff assembly, according to one or more embodiments. The method 300 may include introducing the process fluid to an outer pipe of the fluid takeoff assembly via an inlet thereof, as shown at 302. The method 300 may also include flowing the process fluid through an annular space of the fluid takeoff assembly, as shown at 304. An inner radial surface of the outer pipe and an outer radial surface of an inner pipe of the fluid takeoff assembly may at least partially define the annular space therebetween. The method 300 may further include at least partially inducing a swirling flow in the process fluid flowing through the annular space with a plurality of vanes and a cross-flow member to direct at least a portion of the contaminants contained in the process fluid toward the inner radial surface of the outer pipe and thereby provide a flow of a relatively clean process fluid along the outer radial surface of the inner pipe, as shown at 306. The method 300 may also include flowing a portion of the relatively clean process fluid to a fluid passage of the inner pipe via an open axial end thereof, as shown at 308. The open axial end of the inner pipe may be disposed proximal an outlet of the outer pipe. The method 300 may also include flowing the portion the relatively clean process fluid from the fluid passage to a flowpath of the cross-flow member via a radial opening of the inner pipe, as shown at 310. The method 300 may further include flowing the portion of the relatively clean process fluid from the flowpath of the cross-flow member to the cooling system of the motor-compressor, as shown at 312.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

We claim:

1. A fluid takeoff assembly for a motor-compressor, comprising:

an outer pipe having an inlet and an outlet;

an inner pipe defining a fluid passage extending from an open axial end toward a closed axial end thereof and a radial opening fluidly coupled with the fluid passage, the inner pipe at least partially disposed in the outer pipe such that the open axial end is oriented toward the outlet of the outer pipe, the closed axial end is oriented toward the inlet of the outer pipe, and the inner pipe and the outer pipe at least partially define an annular space therebetween;

a cross-flow member coupled with the inner pipe and defining a flowpath fluidly coupled with the fluid passage via the radial opening, the cross-flow member at least partially disposed in the annular space and configured to at least partially induce a swirling flow in a process fluid flowing through the annular space; and a vane disposed in the annular space and coupled with the inner pipe, the vane configured to at least partially induce the swirling flow in the process fluid flowing through the annular space.

2. The fluid takeoff assembly of claim 1, wherein the cross-flow member and the vane are uniformly disposed about the inner pipe in an annular array.

3. The fluid takeoff assembly of claim 1, wherein at least a portion of the closed axial end of the inner pipe is arcuate and configured to deflect at least a portion of the process fluid directed thereto toward the annular space.

4. The fluid takeoff assembly of claim 1, wherein the outer pipe defines an opening extending radially therethrough, and the cross-flow member at least partially extends through the opening of the outer pipe.

5. The fluid takeoff assembly of claim 4, wherein the cross-flow member is coupled with the inner pipe and the outer pipe.

6. The fluid takeoff assembly of claim 1, further comprising:

a first mounting flange disposed about the inlet of the outer pipe and configured to detachably and fluidly couple the outer pipe with a discharge line of the motor-compressor; and a second mounting flange disposed about the outlet of the outer pipe.

7. A fluid takeoff assembly for a motor-compressor, comprising:

an outer pipe having a first axial end portion defining an inlet thereof and a second axial end portion defining an outlet thereof;

an inner pipe having an open axial end and a closed axial end, the inner pipe defining a fluid passage extending from the open axial end toward the closed axial end and a radial opening fluidly coupled with the fluid passage, the inner pipe at least partially disposed in the outer pipe such that the open axial end and the closed axial end thereof are disposed proximal the outlet and the inlet of the outer pipe, respectively, the inner pipe and the outer pipe at least partially defining an annular space therebetween;

a cross-flow member coupled with the inner pipe and defining a flowpath fluidly coupled with the fluid passage via the radial opening, the cross-flow member at least partially disposed in the annular space and configured to at least partially induce a swirling flow in a process fluid flowing through the annular space; and a plurality of vanes disposed in the annular space and coupled with the inner pipe, the plurality of vanes configured to at least partially induce the swirling flow in the process fluid flowing through the annular space.

8. The fluid takeoff assembly of claim 7, wherein the cross-flow member and the plurality of vanes are uniformly arrayed about the inner pipe.

9. The fluid takeoff assembly of claim 7, wherein the cross-flow member and the plurality of vanes are helically oriented relative to a longitudinal axis of the outer pipe.

10. The fluid takeoff assembly of claim 7, wherein at least a portion of the closed axial end of the inner pipe is curved and configured to deflect at least a portion of the process fluid directed thereto toward the annular space.

11. The fluid takeoff assembly of claim 7, wherein the outer pipe defines an opening extending therethrough from an outer radial surface to an inner radial surface thereof, and the cross-flow member extends through the opening of the outer pipe.

12. The fluid takeoff assembly of claim 7, wherein the plurality of vanes are coupled with the inner pipe and the outer pipe and configured to support the inner pipe within the outer pipe.

13. The fluid takeoff assembly of claim 7, further comprising a mounting flange disposed about the inlet of the outer pipe and defining a plurality of openings extending therethrough, each opening of the plurality of openings configured to receive a mechanical fastener to detachably and fluidly couple the inlet of the outer pipe with a line of the motor-compressor.

14. A method for removing contaminant from a process fluid introduced into a cooling system of a motor-compressor with a fluid takeoff assembly, the method comprising:

introducing the process fluid to an outer pipe of the fluid takeoff assembly via an inlet thereof;

flowing the process fluid through an annular space of the fluid takeoff assembly, an inner radial surface of the outer pipe and an outer radial surface of an inner pipe of the fluid takeoff assembly at least partially defining the annular space therebetween;

at least partially inducing a swirling flow in the process fluid flowing through the annular space with a plurality of vanes and a cross-flow member to direct at least a portion of the contaminants contained in the process fluid toward the inner radial surface of the outer pipe and thereby provide a flow of a relatively clean process fluid along the outer radial surface of the inner pipe;

flowing a portion of the relatively clean process fluid to a fluid passage of the inner pipe via an open axial end thereof, the open axial end of the inner pipe disposed proximal an outlet of the outer pipe;

flowing the portion of the relatively clean process fluid from the fluid passage to a flowpath of the cross-flow member via a radial opening of the inner pipe; and flowing the portion of the relatively clean process fluid from the flowpath of the cross-flow member to the cooling system of the motor-compressor.

15. The method of claim 14, further comprising turning the flow of the relatively clean process fluid before flowing the portion of the relatively clean process fluid to the fluid passage of the inner pipe to thereby direct at least a portion of the contaminants contained in the flow of the relatively clean process fluid toward the inner radial surface of the outer pipe.

16. The method of claim 15, wherein turning the flow of the relatively clean process fluid before flowing the portion of the relatively clean process fluid to the fluid passage of the inner pipe comprises turning the flow of the relatively clean process fluid about 180 degrees.

17. The method of claim 14, further comprising deflecting at least a portion of the process fluid toward the inner radial surface of the outer pipe with a closed axial end of the inner pipe, the closed axial end of the inner pipe disposed proximal the inlet of the outer pipe.

18. The method of claim 14, further comprising discharging the process fluid from the motor-compressor before introducing the process fluid to the outer pipe of the fluid takeoff assembly.

19. The method of claim 14, wherein at least partially inducing the swirling flow in the process fluid flowing through the annular space with the plurality of vanes and the cross-flow member comprises helically orienting the plurality of vanes and the cross-flow member relative to a longitudinal axis of the outer pipe.

20. The method of claim 14, further comprising:

detachably and fluidly coupling the inlet of the outer pipe with a discharge line of the motor-compressor; and detachably and fluidly coupling an outlet of the cross-flow member with a line of the cooling system.

* * * * *